United States Patent [19]

Arkharov et al.

[11] 4,444,019

[45] Apr. 24, 1984

[54] METHOD OF COLD GENERATION AND A PLANT FOR ACCOMPLISHING SAME

[76] Inventors: Alexei M. Arkharov, Rostovskaya naberezhnaya, 5, kv. 103, Moscow; Alexandr T. Desyatov, ulitsa Textilschikov, 11, kv. 7; Vitaly L. Bondarenko, ulitsa, Bykovskogo, 16, kv. 6, both of Moskovskaya oblast, Balashikha, all of U.S.S.R.; Vladimir G. Pronko, deceased, late of Moscow, U.S.S.R.; Natalia D. Pronko, heir, II B. Kozlovsky perculok, kv. 42, Moscow, U.S.S.R.; Boris D. Krakovsky, Narodnaya ulitsa, 13, kv. 136, Moscow, U.S.S.R.; Sergei M. Korsakov-Bogatkov, 5 Parkovaya ulitsa, 56, korpus 6, kv. 74, Moscow, U.S.S.R.; Viktor P. Jushin, Proletarsky prospekt, 64, korpus 1, kv. 72, Moscow, U.S.S.R.; Alexandra M. Kopova, ulitsa 26 Bakinskikh Komissarov, 3, korpus 3, kv. 229, Moscow, U.S.S.R.; Petr V. Gorodnov, 3 Setunsky proezd, 3, kv. 299, Moscow, U.S.S.R.; Julian Y. Borisov, Frunzensky val, 4, kv. 80, Moscow, U.S.S.R.; Vadim V. Ermilov, 7 mikroraion, 21, kv. 29, Alma-Ata, U.S.S.R.; Jury P. Romanteev, ulitsa Mirzoiana, 118, kv. 18, Alma-Ata, U.S.S.R.

[21] Appl. No.: 293,126

[22] Filed: Aug. 17, 1981

[30] Foreign Application Priority Data

Sep. 8, 1980 [SU] U.S.S.R. ..... 2970551

[51] Int. Cl.[3] ..... F25B 9/00

[52] U.S. Cl. ..... 62/87; 62/402; 62/467 R

[58] Field of Search ..... 62/86, 87, 88, 401, 62/402, 467 R

[56] References Cited

U.S. PATENT DOCUMENTS

| | | | |
|---|---|---|---|
| 2,519,619 | 8/1950 | Yellott et al. | 116/237 |
| 3,237,421 | 3/1966 | Gifford | 62/88 |
| 3,321,930 | 5/1967 | LaFleur | 62/87 |
| 4,048,814 | 9/1977 | Quack | 62/335 |

OTHER PUBLICATIONS

"Theory and Design of Cryogenic Systems," by A. M. Arkharov, I. V. Marfenina, E. I. Mikulin, Mashinostroiyeniye Publishers, Moscow, 1978, pp. 118–119, 209–216, 235–236, 209–210.

"Air Separation by Deep Cooling: Engineering and Equipment," Ed. by V. I. Epifanova and L. S. Akselrod, 2nd Ed., Mashinostroiyeniye Pub., Moscow, 1973, vol. I, pp. 24, 31, vol. II, pp. 198, 251.

*Primary Examiner*—Ronald C. Capossela

*Attorney, Agent, or Firm*—Fleit, Jacobson, Cohn & Price

[57] ABSTRACT

The herein disclosed method of cold generation provides for the compression of refrigerant and its subsequent cooling. Then, at least part of the refrigerant flow is expanded, accompanied by the generation of acoustic or another type of wave energy which is extracted from the expansion zone by way of converting it to energy of another kind. Provision is made of a plant for accomplishing the method, wherein a refrigerant expansion device 20 includes a gas-jet mechanowave converter 21 and a wave energy converter 22 in the wave relationship therewith.

9 Claims, 6 Drawing Figures

METHOD OF COLD GENERATION AND A PLANT FOR ACCOMPLISHING SAME

The present invention relates to the field of refrigeration engineering and, more particularly, it relates to a method of cold generation and a plant for accomplishing same.

This invention can be used most advantageously in the generation of cold at the level of temperatures close to the boiling point of refrigerant circulating in a refrigerating plant, especially so, if light gases such as helium or hydrogen are used as refrigerant.

The present invention can be further used for refrigeration and liquefaction of natural gas, as well as for separation of air and other gaseous media, when low temperatures are attained or utilized in the various fields such as physical experiment, power engineering, nuclear engineering, electrical engineering, biology etc.

The currently growing demand for helium cryogenic systems is accompanied with considerably higher requirements placed upon their technical and economic characteristics such as efficiency, energy consumption, reliability of operation etc. This phenomenon in cryogenic engineering is mainly due to a rapid progress of research and applied development related to the utilization of the superconductivity effect in the development of electrotechnical equipment, powerful magnets, power transmission lines, electronic devices, as well as to the extensive use of liquid hydrogen.

Superconducting devices operate at temperatures of from 1.5 to 15 K. The power consumed by cryogenic plants for cooling large objects amounts to hundreds and thousands of kilowatt.

All this calls for reduced energy consumption in the generation of cold and for improvements in the plants from the viewpoint of reliability of operation, reduced weight and overall dimensions etc. In many instances, it is also important that the temperature level of generated cold be decreased while maintaining a high process efficiency.

It is known to those skilled in the art of refrigeration and cryogenic engineering that the "refrigerating capacity" defines the amount of cold generated by a plant per unit time at a given temperature level.

There is known in the art a method of cold generation in cryogenic plants (cf. *Razdeleniye vozdukha metodum glubokogo okhlazhdeniya—Air Separation by Intense Cooling,* ed. by V. I. Epifanova and L. S. Akselrod, 2nd edition, Mashinostroiyeniye Publishers, Moscow, 1973, vol. I, pp. 24, 31, vol. II, pp. 198, 251), which comprises the steps of compression, at the environmental temperature, of a gaseous refrigerant such as air forming a forward flow, its subsequent cooling by the return flow of said refrigerant to a temperature whose absolute value is 2–3 times less than the environmental temperature, and further expansion of at least a part of the forward flow upon its efflux, with the external work extracted in the form of mechanical energy, i.e., expansion.

As those skilled in the art will understand, referred to as "circumambient medium" is the plurality of any objects surrounding the refrigerant expansion device. It will be further understood by those skilled in the art that the term "environment" is used to denote the plurality of any objects surrounding the plant for accomplishing the method of cold generation. The environmental temperature is generally assumed constant while the temperature of circumambient medium may vary.

As is further known to those skilled in the art, the term "expansion" is used to denote the process of gas expansion, said gas performing external work. The external work is the work performed by the forces of gaseous refrigerant pressure upon the movable link of the refrigerant expansion device (expander), as a result of which the internal energy of refrigerant is converted to mechanical energy and extracted.

The expanded forward flow is delivered to the consumer of cold where, after heating, the forward flow is transformed to return flow which is further supplied for compression. The cycle is completed and the processes are repeated.

In the course of expansion, there takes place effective cooling of the expanded refrigerant owing to external work performed by the latter.

The expansion process is a reversible one. It means that, rather than dissipating, the energy of expanding gas is converted to mechanical energy and extracted from the expansion zone to be further utilized.

Nevertheless, the realization of the afore-described method of cold generation, utilizing the expansion process, calls for the development of refrigerant expansion devices or expanders operating at low temperatures and, sometimes, under conditions of phase transition of the expanding refrigerant from gaseous to liquid state. The development of such expanders presents a complicated technical problem.

This causes inadequate reliability and durability of expanders operating at low temperatures which, in turn, affects the reliability of cryogenic plants realizing the aforedescribed prior art method of cold generation.

There is known in the art a method of cold generation in cryogenic plants (cf., *Teoriya i raschot krioghennykh sistem—Theory and Calculation of Cryogenic Systems,* by A. M. Arkharov, I. V. Marfenina, E. I. Mikulin, Mashinostroiyeniye Publishers, Moscow, 1978, pp. 118–119, 209–216), which comprises the steps of compression, at the environmental temperature, of a gaseous refrigerant such as nitrogen forming a forward flow to a pressure several times in excess of the critical pressure, its subsequent cooling by the return flow of said refrigerant to a temperature whose absolute value is 2–3 times less than the environmental temperature, and further expansion of at least a part of the forward flow upon its efflux through local hydraulic resistance without the extraction of external work, i.e., expansion by throttling.

It will be understood by those skilled in the art that the term "throttling" is used to define the process of gas expansion when said gas performs no external work. The process of throttling occurs upon the passage of gas through a local hydraulic resistance referred to as throttle. In so doing, the expanding gas performs work while overcoming the forces of friction and local resistance. However, this work is converted to heat and assimilated by the same flow of gas, i.e., it stays in the throttling zone and is not extracted.

The expanded forward flow is delivered to the consumer of cold where, after heating, the forward flow is transformed to return flow which is further supplied for compression. The cycle is completed and the processes are repeated.

In the course of throttling under conditions of cryogenic plants, there takes place the cooling of expanding refrigerant. The refrigerant expansion devices realizing the throttling process, i.e., throttles, have no movable links and, therefore, they do not affect the reliability and durability of cryogenic plants.

However, the efficiency of throttling as an expansion process is inadequate in view of its irreversibility. It means that, rather than being extracted from the throttling zone, the energy of expanding gas is dissipated, i.e., cannot be further utilized.

Therefore, the cooling of refrigerant in the course of throttling is caused by the reduction of energy of expanding gas in the course of compression at the environmental temperature rather than by the extraction of energy from the expanded gas and, strictly speaking, throttling is but a means for attaining, at a given temperature level, the cold due to the compression of refrigerant at the environmental temperature.

An inadequately high efficiency of the prior art method of cold generation wherein throttling is used as the principal process is demonstrated clearly by the fact that the utilization of said method in a cryogenic plant results in an increased specific consumption of power for the generation of cold at a given temperature level.

The power consumption in the course of cold generation is generally characterized by the ratio between power consumed mainly for the compression of refrigerant at the environmental temperature and refrigerating capacity. Both said values are measured in watts. This ratio is usually referred to as specific consumption and expressed with a dimensionless number (W/W).

There is known in the art a plant for accomplishing the method of cold generation (cf., *Teoriya i raschot krioghennykh sistem—Theory and Calculation of Cryogenic Systems,* by A. M. Arkharov, I. V. Marfenina, E. I. Mikulin, Mashinostroiyeniye Publishers, Moscow, 1978, pp. 235–236), comprising a source of compressed refrigerant, such as an isothermal compressor, a cooling system communicated therewith by lines of forward and return flow, and a consumer of cold.

The cooling system includes a heat exchanger and a refrigerant expansion device, such as the afore-described expander, arranged in series in the direction of the forward flow line. The return flow line communicates the consumer of cold via heat exchanger with the source of compressed refrigerant.

The expander used as the refrigerant expansion device is an efficient cold-generating device which provides for refrigerant expansion at low temperatures. The high efficiency of the expander is due to the fact that it is capable of realizing the reversible expansion process described above. However, the expander structure is technically complicated because of the need to effect the expansion process at low temperatures. This affects the reliability and durability of expanders and results in a reduced reliability of the overall plant for accomplishing the method of cold generation, utilizing expansion as the principal process.

There is known in the art a plant for accomplishing the method of cold generation (cf., *Teoriya i raschot krioghennykh system—Theory and Calculation of Cryogenic Systems,* by A. M. Arkharov, I. V. Marfenina, E. I. Mikulin, Mashinostroiyeniye Publishers, Moscow, 1978, pp. 209–210), comprising a source of compressed refrigerant, such as an isothermal compressor, a cooling system communicated therewith by lines of forward and return flow, and a consumer of cold. The cooling system includes a heat exchanger and a refrigerant expansion device, such as the afore-described throttle, arranged in series in the direction of the forward flow line. The return flow line communicates the consumer of cold via heat exchanger with the source of compressed refrigerant.

The throttle used as the refrigerant expansion device is simple and reliable in operation inasmuch as its structure includes no movable links. The use of the throttle has no adverse effect upon the service life and reliability of operation of the overall plant. Nevertheless, its structure is only capable of realizing the inadequately efficient throttling process described above, which leads to an increase of specific power consumption in a plant for accomplishing the method of cold generation, utilizing throttling as the principal process.

It is the principal object of the present invention to develop a method of cold generation and a plant for accomplishing same as would ensure an increased refrigerating capacity at preset energy consumption or reduced energy consumption at preset refrigerating capacity.

Also an important object of the present invention is to develop a method of cold generation and a plant for accomplishing same whose realization would ensure an adequately high reliability of the plant featuring small overall dimensions.

Said and other objects of the present invention are attained in a method of cold generation by way of compressing a refrigerant forming a forward flow, its subsequent cooling by a return flow of said refrigerant and expansion of at least a part of the forward flow whereupon the forward flow is directed to a consumer of cold where the forward flow is converted, upon heating, to a return flow which is further supplied for compression, wherein, according to the present invention, the expansion of at least a part of the forward flow is accompanied by the generation of wave energy extracted from the expansion zone by converting it to energy of another kind.

By so performing the expansion process, its efficiency is increased as compared with that of the throttling process because the wave energy extracted from the expansion zone presents external work with respect to the expanded refrigerant. The value of this work defines the possible additional refrigerating capacity in the herein disclosed expansion process.

It is expedient that the wave energy be extracted from the expansion zone by way of converting it to heat energy.

Such a technical solution helps extract the wave energy converted to heat from the expansion zone having a lower temperature to a plant zone having a higher temperature, which is equivalent to the generation of additional amount of cold in the expansion zone and, on the whole, results in an increased refrigerating capacity of the plant accomplishing the herein disclosed method of cold generation.

This technical solution is especially important inasmuch as the wave-to-heat energy conversion ratio is very high.

It is further recommended that the wave energy be extracted from the expansion zone by way of converting it to electric energy.

This enables one to extract the converted wave energy via electrodes outside of the low-temperature portion of the plant for accomplishing the herein disclosed method of cold generation and further utilize the extracted electric energy, which is equivalent to reducing the specific power consumption for cold generation.

Said objects of the present invention are further attained in a plant for accomplishing the disclosed method of cold generation, comprising a source of compressed refrigerant and a cooling system communicated therewith by means of a forward flow line and having at least one refrigerant expansion device, said system being further communicated with the consumer of cold communicated, in turn, with the source of compressed refrigerant by means of a return flow line passing through said cooling system, wherein, according to the present invention, at least one refrigerant expansion device would include, positioned in a chamber communicated with the forward flow line, a gas-jet mechanowave converter connected to the forward flow line and a wave energy converter in wave relationship with the gas-jet mechanowave converter and in energy contact with the circumambient medium whose temperature level exceeds that of the gas-jet mechanowave converter.

As a result of such a technical solution, the refrigerant expansion device in the plant of the invention possesses adequate efficiency while retaining its reliability and simplicity of manufacture. Said device is adequately efficient because it utilizes efficiently the afore-described method of cold generation according to the invention.

It is recommended that, in the herein disclosed plant for accomplishing the method of cold generation, the wave energy converter be fashioned as a sleeve whose open end would face the gas-jet mechanowave converter while its closed end be in thermal contact with the circumambient medium.

Such a structural arrangement of the wave energy converter makes for a reliable and rather simple transfer of wave energy from the gas-jet mechanowave converter, with subsequent conversion of said energy to heat and its removal to the circumambient medium.

This is due to the fact that the sleeve, closed at one end and facing the gas-jet mechanowave converter with its open end, presents a waveguide inside which there propagate elastic vibrations of the gas medium developed by the mechanowave converter. In so doing, the energy of elastic vibrations is converted to heat, which results in the heating of the open end of the sleeve in thermal contact with the circumambient medium and, in this manner, heat is extracted to the circumambient medium.

It is expedient that in the plant for accomplishing the method of cold generation, wherein the gas-jet mechanowave converter is fashioned as a gas-jet rod wave radiator, the chamber of the refrigerant expansion device would have the shape of an ellipsoid in whose first (in the direction of the forward flow line) focal zone said gas-jet rod wave radiator be located while in another focal zone of the ellipsoid there would be located a wave energy converter fashioned as a heat-conducting element positioned alongside the longer axis of the ellipsoid and extending from the chamber by its one end which is in thermal contact with the circumambient medium.

Owing to this arrangement, the wave energy radiated by the gas-jet rod radiator can be concentrated in the second focal zone of the expansion chamber, converted to heat and, via the heat-conducting element, extracted to the circumambient medium, whereby the refrigerant expanded in the chamber is cooled.

It is further expedient that in the plant for accomplishing the method of cold generation, wherein the gas-jet mechanowave converter is fashioned as a gas-jet rod wave radiator, the chamber of the refrigerant expansion device would have the shape of an ellipsoid in whose first (in the direction of the forward flow line) focal zone said gas-jet rod wave radiator would be located while in another focal zone of the ellipsoid there would be located a wave energy converter fashioned as a conventional electroacoustic transducer in electric relationship with the circumambient medium.

Such an arrangement makes for the extraction of electric energy, rather than heat, from the refrigerated expansion chamber, which is especially beneficial in case the extracted electric energy is further utilized to satisfy the power needs of the plant for accomplishing the method of cold generation.

It is also advisable that in the herein-disclosed plant for accomplishing the method of cold generation, wherein the gas-jet rod wave radiator includes, arranged along the longer axis of the ellipsoid, a rod supporting at its end a resonator fashioned as a sleeve and a contracting nozzle communicated with the forward flow line and encircling the rod, the face plane of said nozzle being at some distance from the open end of the resonator, the rod would have on its outer surface a cylindrical projection located in a face plane zone of the nozzle with a gap relative to the inner surface of the nozzle at its face plane, the value of the gap being defined, depending on the width of the cylindrical projection and the diameter of the rod outside the nozzle, the diameter of the rod inside the nozzle and the inner diameter of the contracting nozzle at the face plane, by the relation:

$\delta=0.5\ (d_n-d_r)$, with $t\geqq 0.5\delta$ $t=0.5\ (d_r-d)$ where $\delta$—the value of the gap, in m;

$d_n$—inner diameter of the nozzle at the face plane, in m;

d—diameter of the rod inside the nozzle, in m;

t—width of the cylindrical projection, in m;

$d_r$—diameter of the rod, outside the nozzle in m;

Said technical solution makes for the radiation of the maximum wave power upon the expansion of refrigerant in the gas-jet rod wave radiator.

When the relation $t\geqq 0.5\delta$ is satisfied, there occurs the destruction of boundary layer in the jet of refrigerant formed on the outer surface of the rod, effluent from the nozzle. This helps increase the radiated wave power.

It is also expedient that in the plant for accomplishing the herein disclosed method of cold generation, wherein the gas-jet rod wave radiator includes, arranged along the longer axis of the ellipsoid, a rod supporting at its end a resonator fashioned as a sleeve and a contracting nozzle communicated with the forward line flow and encircling the rod, the face plane of said nozzle being at some distance from the open end of the resonator, at the closed end of the resonator provision would be made of cooling means fashioned as ribs in thermal contact with the circumambient medium, said ribs extending from the end wall of the resonator in the direction of the longer axis of the ellipsoid and, from the side wall of the resonator, in the direction normal to the longer axis of the ellipsoid.

Such a solution helps simplify the structure of the afore-described refrigerant expansion device and, consequently, the overall plant structure.

This can be attributed to the fact that the wave energy radiated by the gas-jet rod wave radiator is converted to heat in the resonator and extracted to the circumambient medium directly from the resonator, i.e., there is eliminated the step of delivering the wave energy to the wave energy converter whose function is served by the resonator provided with cooling means.

Therefore, the herein disclosed method of cold generation and plant for accomplishing same provide for a considerable increase of the refrigerating capacity at preset energy consumption or a decrease of the energy consumption for cold generation while maintaining the refrigerating capacity, owing to the use of a more reversible process of refrigerant expansion and the utilization of technical solutions embodying such process.

There is further ensured a sufficiently high reliability of the plant for accomplishing the method of cold generation, without increasing the overall dimensions of the plant.

Said and other advantages of the present invention will be more apparent upon considering the following detailed description of preferred embodiments thereof, with due reference to the accompanying drawings in which.

Figure 5:
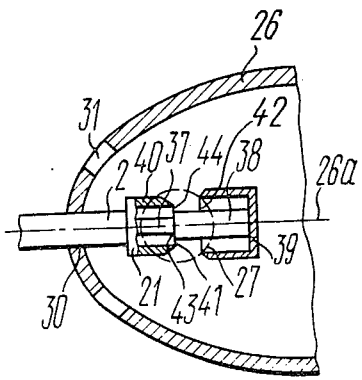
Figure 6:
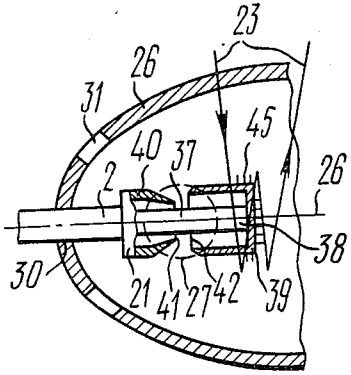

FIG. 5 shows diagrammatically a refrigerant expansion device according to the present invention, said device having a chamber in the shape of an ellipsoid while the gas-jet rod wave radiator includes a rod with resonator and a nozzle encircling the rod, arranged along the longer axis of the ellipsoid; conventionally shown is a part of the chamber with the gas-jet rod wave radiator; and FIG. 6—ditto, but the resonator provided with cooling means; the partial forward flow line conventionally shown as a helical turn.

The herein described method of cold generation according to the present invention is realized in the following manner.

A gaseous refrigerant is isothermally compressed, at the environmental temperature, to a pressure several times in excess of the critical pressure of said gaseous refrigerant, thereby forming a forward flow.

The forward flow of compressed refrigerant is then cooled by a return flow of said refrigerant to a temperature depending upon the thermophysical properties of the refrigerant, whereupon at least a part of forward flow is expanded after which the forward flow is delivered to a consumer of cold.

At the latter station, the forward flow of refrigerant is heated by the heat extracted from the consumer of cold and transformed to a return flow which is further supplied for compression. In so doing, the expansion of at least a part of the forward flow is accompanied by the generation of wave energy extracted from the expansion zone by converting it to energy of another kind. In a first embodiment of the method of cold generation according to the present invention, the generated wave energy is extracted from the expansion zone by converting it to heat energy. In a second embodiment of the method of cold generation according to the present invention, the generated wave energy is extracted from the expansion zone by converting it to electric energy.

The herein disclosed method of cold generation will be further considered in more detail in conjunction with the following description of the operation of the plant for accomplishing the method of cold generation.

The plant for accomplishing the herein disclosed method of cold generation is arranged as follows.

Figure 1:
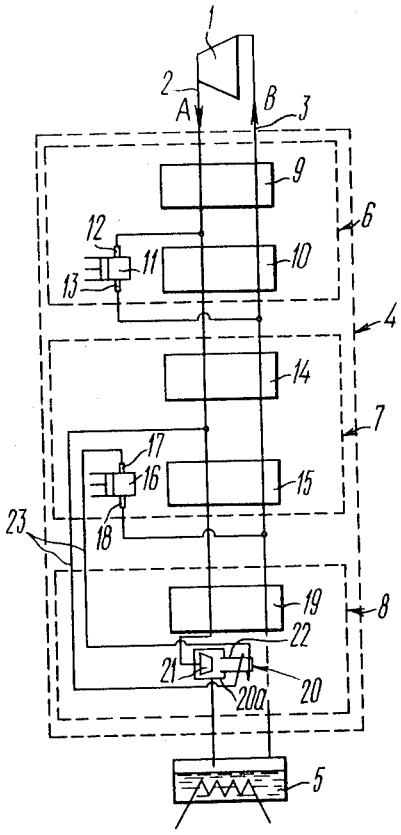
FIG. 1 shows diagrammatically the plant for accomplishing the method of cold generation according to the present invention.

Referring now to FIG. 1 of the accompanying drawings, the plant of the present invention comprises a source 1 of compressed refrigerant, represented by a compressor of conventional design also shown at 1.

Helium gas serves as refrigerant in the case under consideration.

Branching out from the compressor 1 is a forward flow line 2 and a return flow line 3, represented by standard pipelines also shown at 2 and 3, respectively.

The plant further comprises a cooling system 4 communicated with the compressor 1 by the forward flow line 2, and a consumer 5 of cold communicated with the cooling system 4 also by means of the forward line 2 and with the compressor 1—by means of the return flow line 3 passing through the cooling system 4.

The cooling system 4 includes three cooling stages 6, 7 and 8 arranged in series in the direction of the forward flow line 2, as shown by arrow A in FIG. 1.

The cooling stages 6, 7 and 8 are communicated with each other, with the compressor 1 and with the consumer 5 of cold by means of the forward flow line 2 and return flow line 3.

In other cases, a single cooling stage may be used, or more than three cooling stages. This depends upon the properties of refrigerant circulating in the plant, as well as reliability and energy efficiency considerations.

The first (in the forward flow direction A) cooling stage 6 includes conventional heat exchangers 9 and 10 also arranged in series in the forward flow direction A.

The cooling stage 6 further includes an expander 11 designed for expanding a part of the forward flow. The expander 11 may be of any suitable conventional design.

The expander 11 is connected by its inlet 12 to the forward flow line 2 in the portion thereof between the heat exchangers 9 and 19, and by its outlet 13—to the return flow line 3 in the portion between the heat exchanger 10 and the cooling stage 7.

The cooling stage 7 includes heat exchangers 14 and 15 arranged, similarly with the heat exchangers 9 and 10, in series in the forward flow direction A, and an expander 16. The expander 16 is designed for expanding a part of the forward flow and may be of any suitable conventional design.

The expander 16 is communicated by its inlet 17 with the forward flow line 2 in the portion between the heat exchangers 14 and 15, and by its outlet 18—to the return flow line 3 in the portion between the heat exchanger 15 and the cooling stage 8.

The cooling stage 8 includes a heat exchanger 19 of conventional design arranged analogously with the heat exchangers 14 and 15 in the forward flow direction A, and a refrigerant expansion device 20 connected to the forward flow line 2 in the portion between the heat exchanger 19 and the consumer 5 of cold.

The consumer 5 of cold is represented by a heat-liberating screen shown at 5 and having any conventional design. The cold consumer 5 is designed for extracting cold from the forward flow and for shaping the return flow in direction B, said return flow passing successively through the cooling stages 8, 7 and 6 and communicated with the source 1 of compressed refrigerant.

The refrigerant expansion device 20 comprises a chamber 20*a* communicating with the forward flow line 2 via outlet opening (not shown in the drawings) and, located in said chamber, a gas-jet mechanowave converter 21 connected to the forward flow line 2 and a wave energy converter 22 in wave relationship with said gas-jet mechanowave converter 21 and also in energy contact with the circumambient medium whose temperature level exceeds that of the gas-jet mechanowave converter 21. Serving as the circumambient medium in this case is the part of the forward flow leaving the forward flow line 2 in the portion between the heat exchangers 14 and 15 and passing via line 23 fashioned as a conventional pipeline also shown at 23 and enveloping the outer surface of the wave energy converter 22. The partial foward flow line 23 is further communicated with the inlet 17 of the expander 16.

Figure 2:
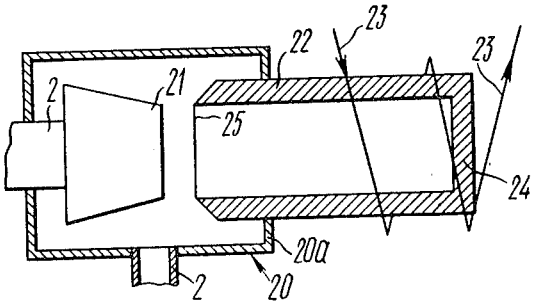
FIG. 2 shows diagrammatically a refrigerant expansion device according to the present invention, wherein the wave energy converter is fashioned as a sleeve, on an enlarged scale, in partial longitudinal section; the partial forward flow line shown conventionally as a helical turn.

As shown in FIG. 2, the wave energy converter 22 is fashioned as a sleeve shown at 22 and having a closed end 24 and an open end 25. The closed end 24 of the sleeve 22 is most removed from the gas-jet mechanowave converter 21 and in thermal contact with the circumambient medium while the open end 25 of the sleeve 22 is facing the gas-jet mechanowave converter 22 such that the maximum amount of wave energy radiated by the converter 21 be transmitted over the inner space of the sleeve 22 towards the closed end 24 thereof. The thermal contact of the closed end 24 of the sleeve 22 with said circumambient medium is effected by means of heat transfer to the part of forward flow passing via the line 23.

Figure 3:
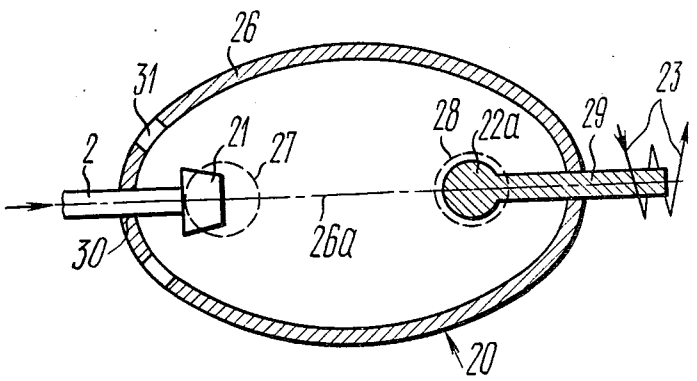
FIG. 3 illustrates diagrammatically a refrigerant expansion device according to the present invention, said device having a chamber in the form of an ellipsoid while the wave energy converter is fashioned as a heat-conducting element; the partial forward flow line shown conventionally as a helical turn.

In another case, as shown in FIG. 3, the refrigerant expansion device 20 includes a chamber 26 shaped as an ellipsoid in whose first (in the direction of forward flow) focal zone 27 there is located the gas-jet mechanowave converter 21 fashioned as a gas-jet rod wave radiator likewise shown at 21 and communicated with the forward flow line 2.

A wave energy converter 22*a* is located in a second focal zone 28 of the chamber 26 and fashioned as a heat-conducting element of any conventional design, also shown at 22*a*, positioned along the longer axis 26*a* of the ellipsoid and extending from the chamber 26 by its one end 29 which is in thermal contact with the circumambient medium. The chamber 26 has a port 30 for the inlet thereto and two ports 31 for the outlet therefrom of the line 2 of forward flow expanded in the gas-jet rod wave radiator 21.

The thermal contact of the end 29 of the heat-conducting element 22, extending from the chamber 26, is effected by means of heat transfer to the part of forward flow passing via the line 23.

Figure 4:
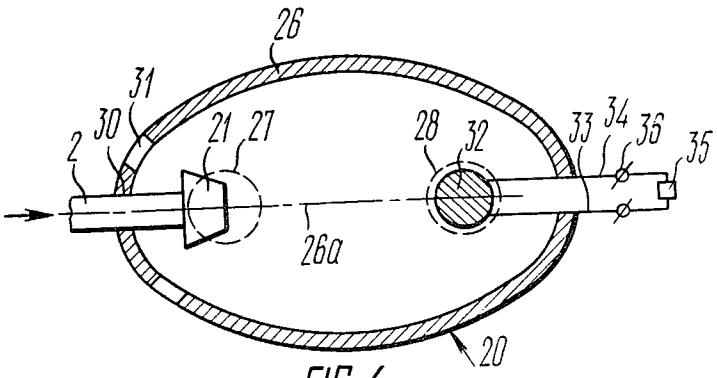
FIG. 4 shows diagrammatically a refrigerant expansion device according to the present invention, said device having a chamber in the form of an ellipsoid while the wave energy converter is fashioned as a conventional electroacoustic transducer.

In the case shown in FIG. 4, the refrigerant expansion device 20 likewise includes the chamber 26 shaped as an ellipsoid whose first (in the direction of forward flow) focal zone 27 houses the gas-jet mechanowave converter 21 likewise fashioned as a gas-jet rod wave radiator shown at 21 and communicated with the forward flow line 2, and a wave energy converter 32 located in the second focal zone 28 of the chamber 26 and fashioned as a conventional electroacoustic transducer (also shown at 32) in electric contact with the circumambient medium.

The chamber 26 is further provided with the port 30 for the inlet thereto and ports 31 for the outlet therefrom of the line 2 of forward flow expanded in the gas-jet rod wave radiator 21.

The electric contact of the electroacoustic transducer 32 with the afore-mentioned circumambient medium is effected by transmitting electric energy via wires 33, 34 outside of the chamber 26 where they are connected to an electric power consumer 35 via terminals 36, presenting a constituent part of the medium that is circumambient with respect to the refrigerant expansion device 20.

Referring now to FIG. 5, the gas-jet rod wave radiator 21 located in the ellipsoidal chamber 26 includes, arranged along the longer axis 26*a* of the ellipsoid, a rod 37 supporting at its end 38 a resonator 39 and a contracting nozzle 40 communicated with the forward flow line 2 and encircling the rod 37, the face plane 41 of said nozzle being at some distance from an open end 42 of the resonator 39.

The rod 37 has on its outer surface a cylindrical projection 43 located in the face plane zone 41 of the nozzle 40 with a gap 44 relative to the inner surface of the nozzle 40 at the face plane 41 thereof. The value of the gap 44 is defined, depending on the width of the cylindrical projection 43 and the diameter of the rod 37 inside the nozzle 40, the diameter of the rod 37 on the end 38 thereof outside the nozzle 40 and inner diameter of the contracting nozzle 40 at the face plane 41, by the following relation:

$\delta=0.5(d_n-d_r)$, with $t\geqq 0.5\delta$; $t=0.5\ (d_r-d)$ where $\delta$—the value of the gap 44, in m;

$d_n$—inner diameter of the contracting nozzle 40 at the face plane 41, in m;

d—diameter of the rod 37 inside the nozzle 40, in m;

t—width of the cylindrical projection 43, in m;

$d_r$—diameter of the rod 37 on the end 38 thereof outside the nozzle 40, in m.

In the case shown in FIG. 6, the gas-jet rod wave radiator 21 located in the ellipsoidal chamber 26 likewise includes, arranged along the longer axis 26*a* of the ellipsoid, the rod 37 supporting at its end 38 the resonator 39 and the contracting nozzle 40 communicated with the forward flow line 2 and encircling the rod 37, the face plane 41 of said nozzle being at some distance from the open end 42 of the resonator 29 while at the closed end of the resonator 39 provision is made of cooling means 45 in thermal contact with the circumambient medium.

The cooling means 45 include ribs also shown at 45, said ribs extending from the end wall of the resonator 39 in the direction of the longer axis 26*a* of the ellipsoid and, from the side wall of the resonator 39, in the direction normal to the longer axis 26*a* of the ellipsoid, while the thermal contact of the cooling means 45 with the circumambient medium is effected by means of heat transfer. Serving as the circumambient medium in this case is the part of the forward flow supplied via the line 23 inside the chamber 26 through openings not shown in the drawings.

The herein disclosed plant for accomplishing the method of cold generation according to the invention operates in the following manner.

The operation of the plant starts with that of the compressor 1.

The refrigerant (helium gas in the present case) is compressed in the compressor 1 to a pressure of 25–30 bar at the environmental temperature to develop a forward flow which is successively supplied via the forward flow line 2 in the direction A to the cooling system 4 and cold consumer 5. In the cooling system 4, the forward flow successively passes through the stages 6, 7 and 8 where it is cooled by the return flow supplied via the return flow line 3 in the direction B.

In the first (in the direction A of forward flow) cooling stage 6, the forward flow is cooled down in the heat exchangers 9 and 10 to a temperature two-three times lower than the environmental temperature and is further fed to the cooling stage 7. In so doing, a part of the forward flow is supplied to the inlet 12 of the expander 11 in which it is expanded to a pressure of 1.2–1.3 bar and, via the outlet 13 of the expander 11, directed to the return flow line 3 in the portion between the heat exchanger 10 and cooling stage 7.

In the cooling stage 7, the forward flow is successively cooled in the heat exchangers 14 and 15 to a temperature 14–15 times lower than the environmental temperature and fed to the cooling stage 8. In so doing, a part of the forward flow is supplied via the line 23 to the inlet 17 of the expander 16, expanded in the latter to a pressure of 1.2–1.3 bar and fed, via the outlet 18 of the expander 11, to the return flow line 3 between the heat exchanger 15 and cooling stage 8.

In the cooling stage 8, the remaining part of the forward flow is cooled down in the heat exchanger 19 to a temperature close to critical and fed to the refrigerant expansion device 20 and, further, is supplied to the cold consumer 5 where it is heated owing to the extraction of heat from the cold consumer 5 to form a return flow of expanded helium passing over the return flow line 3 through the cooling stages 8, 7 and 6 to the inlet of compressor 1.

In the refrigerant expansion device 20, the expansion of forward flow to a pressure of 1.2–1.3 bar, at a temperature close to critical, is accompanied by the generation of wave energy in the gas-jet mechanowave converter 21, said wave energy being extracted from the expansion zone by converting it to energy of another kind in the wave energy converter 22.

The extraction of converter energy is done owing to the energy contact of the wave energy converter 22 with the circumambient medium. The wave relationship between the gas-jet mechanowave converter 21 and the wave energy converter 22 ensures the maximum possible extraction of wave energy by converting it to energy of another kind.

In the embodiment of the refrigerant expansion device 20 shown in FIG. 2, the wave energy generated by the gas-jet mechanowave converter 21 is transferred via the wave energy converter 22 through the open end 25 thereof serving in this case as waveguide and, owing to the absorption effect, is converted to heat at the closed end 24 of said wave energy converter. The evolving heat is removed by heat transfer to the circumambient medium presented by the part of the forward flow passing over the line 23. As a result, the compressed helium expanded in the refrigerant expansion device 20 gets cooled.

In the case shown in FIG. 3, the forward flow is supplied in the direction A to the chamber 26 in the refrigerant expansion device 20 and expanded in the gas-jet rod wave radiator 21, which is accompanied by the generation of wave energy. The generated wave energy is concentrated, owing to the effects of reflection from the walls of the chamber 26 in the second focal zone 28, on the surface of the heat-conducting element **22*a* to be converted to heat owing to the absoprtion effects caused by the heat conductivity of the element 22*a***.

The evolving heat is transferred via the heat-conducting element **22*a* to its end 29 extending from the chamber 26 and further, by heat transfer, to the part of the forward flow passing over the line 23. In this manner, the energy of expanded refrigerant is transferred in the form of heat from the expansion zone within the chamber 26 featuring a lower temperature to the circumambient medium featuring a higher temperature. As a result, the expanded refrigerant leaving the chamber 26 via the ports 31** gets cooled.

In another case illustrated in FIG. 4, the forward flow is supplied in the direction A to the chamber 26 in the refrigerant expansion device 20 and expanded in the gas-jet rod wave radiator 21, which is accompanied by the generation of the wave energy. The generated wave energy is concentrated, owing to the effect of reflection from the walls of the chamber 26 in the second focal zone 28, on the surface of the conventional electroacoustic transducer 32 and converted to electric energy.

The evolving electric energy is extracted from the chamber 26 via the wires 34 and supplied to the electric power consumer 35 presenting a constitutent part of the medium that is circumambient with respect to the refrigerant expansion device 20.

In this manner, the energy of expanded refrigerant is transferred in the form of electric energy from the expansion zone within the chamber 26 featuring a lower temperature to the circumambient medium featuring a higher temperature. As a result, the expanded refrigerant leaving the chamber 26 via the ports 31 gets cooled.

In the gas-jet rod wave radiator 21 shown in FIG. 5, there takes place the expansion of compressed refrigerant accompanied by the generation of wave energy. The forward flow of compressed refrigerant is expanded in the contracting nozzle 40 while flowing around the rod 37 with the projection 43, fills the resonator 39, is reflected from the latter and interacts with the flow of helium effluent from the nozzle 40. As a result of such intermittent interaction, wave energy is generated. The projection 43 on the rod 37 destroys the boundary layer in the flow of helium effluent from the nozzle 40, which makes for an increase of the generated wave energy.

The expansion of compressed refrigerant in the gas-jet rod wave radiator 21 illustrated in FIG. 6 is accompanied by the processes analogous with those described above. In so doing, the generated wave energy propagates also over the inner space of the resonator 39 and, owing to the absorption effect, is converted to heat. Thanks to the provision of the cooling means 45 fashioned as ribs likewise shown at 45, the heat evolving on the inner surface of the resonator 39 is transmitted by means of heat transfer to the circumambient medium in the form of the part of forward flow passing over the line 23. Such an extraction to the circumambient medium of a part of energy of expanded refrigerant in the form of heat from the resonator 39 provides for additional cooling of the refrigerant in the course of expansion accompanied by the generation of wave energy.

The herein disclosed method of cold generation and the plant for accomplishing same have been successfully tested under laboratory conditions.

The testing results have demonstrated that the use of the method and plant according to the present invention provides for an increased refrigerating capacity at present energy consumption or for reduced energy consumption at preset refrigerating capacity.

The plant according to the present invention is characterized by an adequately high reliability and small overall dimensions.

What we claim is:

1. A method of cold generation, wherein refrigerant is circulated within a closed circuit having a forward flow line and a return flow line, comprising the steps of:
   - compressing said refrigerant in a compression zone;
   - feeding said compressed refrigerant into said forward flow line;
   - expanding within a refrigerant expansion zone at least part of said refrigerant so as to provide generation of acoustic waves;
   - converting the acoustic wave energy into another energy form suitable for the withdrawal thereof from the refrigerant expansion zone;
   - extracting the energy of said another energy form from said refrigerant expansion zone, thus causing chilling of said refrigerant;
   - supplying said chilled refrigerant to a cold consumer;
   - directing said refrigerant into said return flow line for return to said compression zone for recompression to repeat the cooling cycle.

2. A method of cold generation according to claim 1, wherein said compressed refrigerant is prechilled in said forward flow line prior to reaching said refrigerant expansion zone.

3. A method of cold generation according to claim 2, wherein said refrigerant is prechilled by effecting heat exchange between said refrigerant in said forward flow line and that in said return flow line.

4. A method of cold generation according to claim 1, wherein sid acoustic wave energy is converted into thermal energy.

5. A method of cold generation according to claim 1, wherein said acoustic wave energy is transformed into electrical energy.

6. A method according to claim 5, wherein the transformation into electrical energy occurs within the refrigerant expansion zone, the method further comprising transmitting the electrical energy to an electric power consumer spaced from the refrigerant expansion zone.

7. A method according to claim 1, wherein the expanding of the at least part of said refrigerant includes periodically varying the pressure thereof.

8. A method of generating cryogenic temperatures for cooling a consumer of cold comprising:
   - (a) compressing a refrigerant in a compressor and forming a forward flow of compressed refrigerant;
   - (b) passing the forward flow of compressed refrigerant through heat exchange means to thereby reduce the temperature of the compressed refrigerant;
   - (c) expanding a first part of said compressed refrigerant and furnishing the expanded first part to the heat exchange means to contribute to the reduction of temperature of the forward flow of compressed refrigerant;
   - (d) expanding a second part of said forward flow in an expansion zone to obtain refrigerant at a cryogenic temperature, said expanding being accompanied by generation of acoustic wave energy in said expansion zone;
   - (e) extracting said acoustic wave energy from said expansion zone by sensing said acoustic wave energy and converting said sensed acoustic wave energy to energy of another kind;
   - (f) delivering the refrigerant a cryogenic temperature to a consumer of cold;
   - (g) delivering the refrigerant from the consumer of cold to said heat exchange means for reducing the temperature of the forward flow of compressed refrigerant; and
   - (h) returning refrigerant from said heat exchange means to the compressor for compression.

9. A method according to claim 8, wherein the sensed acoustic wave energy is converted into electrical energy by an electroacoustic transducer located within said expansion zone.

* * * * *